United States Patent [19]

Crean

[11] Patent Number: 4,652,890

[45] Date of Patent: Mar. 24, 1987

[54] HIGH RIGIDITY, LOW CENTER OF GRAVITY POLAR MOUNT FOR DISH TYPE ANTENNA

[76] Inventor: Robert F. Crean, P.O. Box 1431, White River Junction, Vt. 05091

[21] Appl. No.: 634,004

[22] Filed: Jul. 24, 1984

[51] Int. Cl.[4] ..... H01Q 3/04

[52] U.S. Cl. ..... 343/882; 343/766; 248/185

[58] Field of Search ..... 343/880–882, 343/878, 840, 765, 766; 248/185

[56] References Cited

U.S. PATENT DOCUMENTS

| | | | |
|---|---|---|---|
| 4,126,865 | 11/1978 | Longhurst et al. | 343/766 |
| 4,454,515 | 6/1984 | Major et al. | 343/882 |
| 4,475,110 | 10/1984 | Hutchins | 343/882 |
| 4,490,726 | 12/1984 | Weir | 343/840 |
| 4,528,569 | 7/1985 | Felter et al. | 343/882 |

FOREIGN PATENT DOCUMENTS

| | | | |
|---|---|---|---|
| 95405 | 6/1983 | Japan | 343/880 |

OTHER PUBLICATIONS

Long's Electronics Satellite TV Dealer Flyer No. 101, pp. 1–6, 9–82.

*Primary Examiner*—Eli Lieberman
*Assistant Examiner*—Michael C. Wimer
*Attorney, Agent, or Firm*—Sughrue, Mion, Zinn, Macpeak, and Seas

[57] ABSTRACT

A pair of facing channel members, or a short length tube saddle about the upper end of a vertical post and pivotably mounts a rocker assembly in the form of back to back channel bars. A bolt projects across the top of the facing channel members or tubes to locate the rocker bar and facing channel member or tube on the top of a vertically upstanding post. Right angle ball and socket mounts within end plates joining the rocker assembly back to back channel bars have projecting bolts received within paired frame tangs projecting outwardly from an open frame rigidly mounted to the dish antenna. The upper frame tang bears a slot to permit declination adjustment. The sweep, azimuth and latitude axes intersect each other to provide the lowest possible center of gravity for the antenna mount and minimize the moment arms for the members forming the same to thereby provide a highly rigid, heavy wind resistant support for the dish type antenna. A jack plate mounted at right angles to the back to back channel bars and fixed to the ends of the quadrant plates support a linear motor whose opposite end is coupled to the open frame for sweeping the antenna through the satellite zone of the geosynchronous orbit. The quadrant plates lock to the facing channel members or short length tube after mount latitude adjustment.

17 Claims, 10 Drawing Figures

FIG. 3
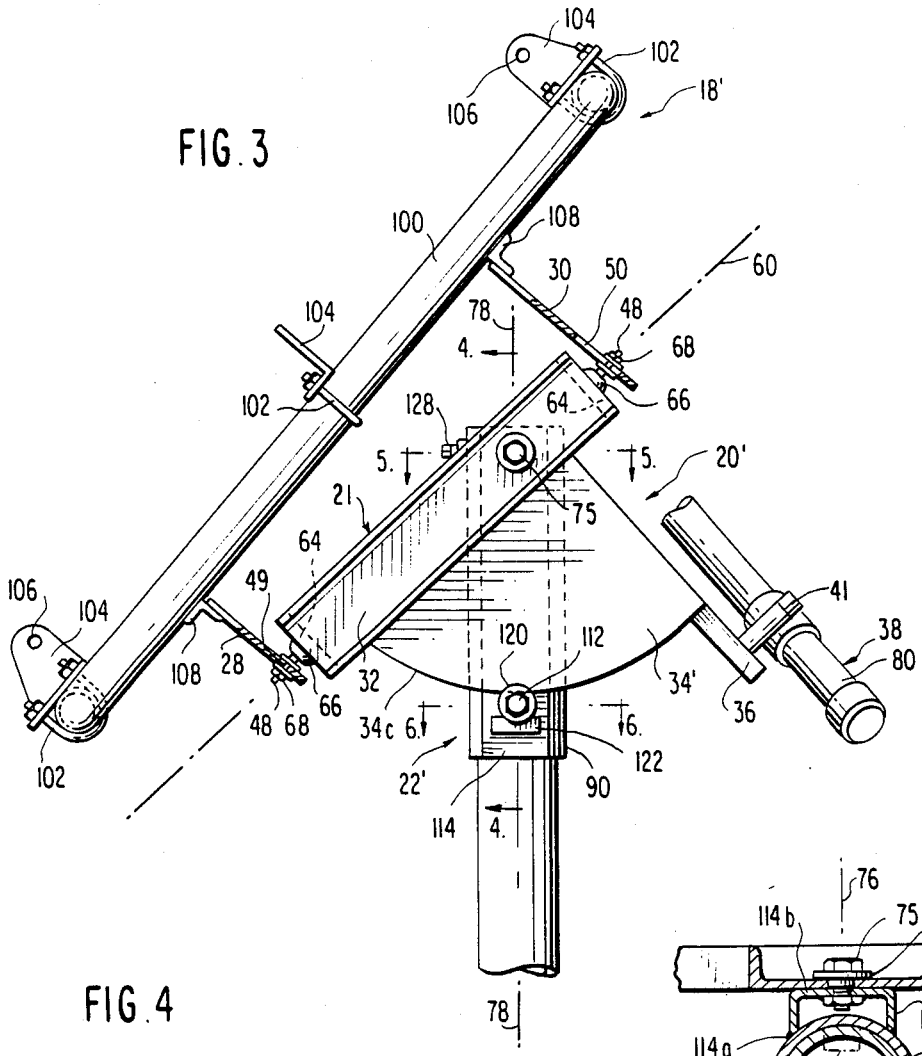
FIG. 4
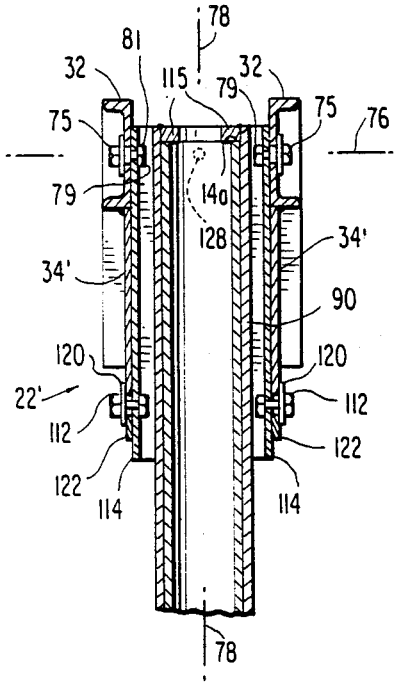
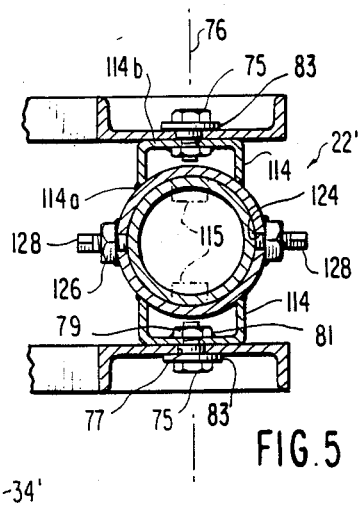
FIG. 5
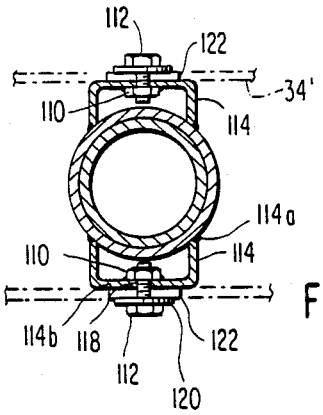
FIG. 6

FIG. 7
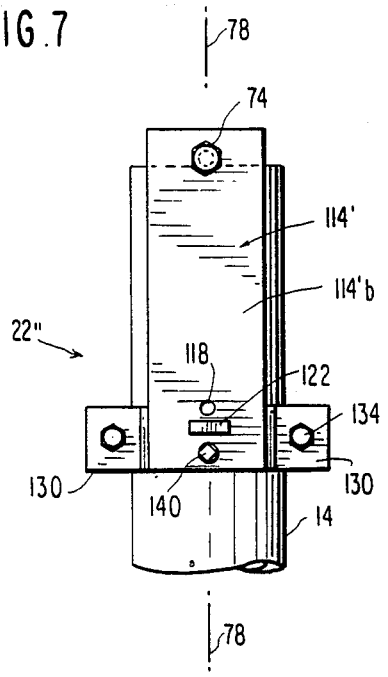
FIG. 9
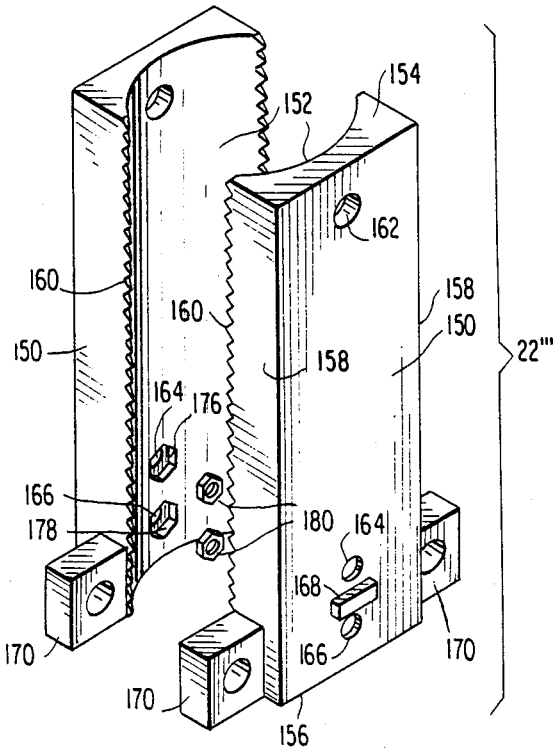
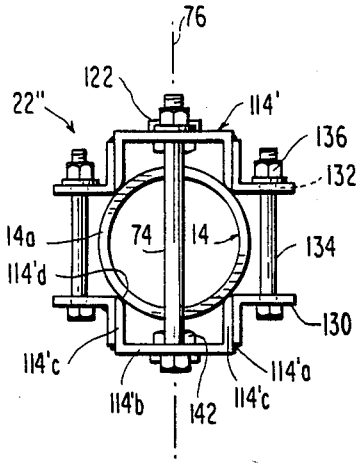
FIG. 8
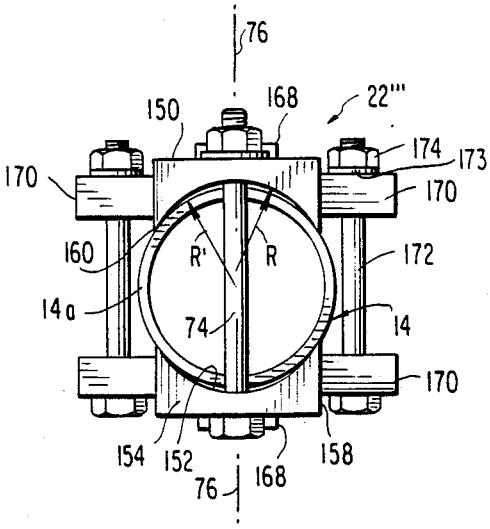
FIG. 10

HIGH RIGIDITY, LOW CENTER OF GRAVITY POLAR MOUNT FOR DISH TYPE ANTENNA

FIELD OF THE INVENTION

This invention relates to a polar mount for a dish type microwave signal satellite antenna, and more particularly, to a low cost, simplified polar mount which is characterized by high rigidity, a very low center of gravity and whose components have minimal moment arms relative to the forces acting on the same. In microwave communication, particularly for the reception of satellite beam television signals, a series of communication satellites beaming such TV signals have been placed exactly 22,300 miles above the equator and in the plane passing through the equator where they revolve around the earth exactly once every twenty-four hours. Predictably, since the earth revolves identically, the net result is that the satellites hover over the same spot on the earth at all times. For small systems users (home television), there have been devised polar mounts having two axes of rotation which are oriented and spaced differently. In the polar mount, the first axis is the elevation axis. The carriage which holds the other axis is rotated about the first axis (elevation axis) until the second axis points to true north (parallel to a line drawn through the earth's poles). Assuming that such polar mounts are utilized at the equator, i.e. in the plane of the geosynchronous satellites, all that is necessary is to rotate the antenna about a second axis to find all of the satellites in the geosynchronous orbit (all those that are visible from a given position on the earth). In this situation, the antenna will travel in an arc directly overhead from east to west or west to east.

As may be appreciated, when the position of the antenna is shifted, either north or sourth of the equator, the ability to sweep the satellite zone of the geosynchronous orbit becomes much more complicated. If one rotates the carriages before so that the second axis is pointed to true north, the antenna (axis) would normally point at right angles to the second axis out into space but would not find any satellites because it would be following an arc in space exactly as many miles as the position of the antenna from the plane of the equator. This requires that a declination correction be made which functions to point the antenna southward somewhat (northward in the southern hemisphere) to intersect the circle of satellites 22,300 miles in space, opposite the equator. Once this is achieved, to find a given satellite in the sector of the circle bearing the satellites at that distance about the center of the earth and within the equatorial plane, the antenna is required to move about only one axis. Once proper elevation control and declination control are achieved with respect to the polar mount, these controls require no changing and the antenna is moved solely in azimuth to sweep from one satellite to the other, normally by the use of a linear motor operatively connecting the mount to the antenna or an open frame to which the dish-type antenna is fixedly attached.

In the past, while such polar mounts have been fabricated, there is no correlation of the various axes of rotation necessary to achieve that end. This causes relatively high moment arms to be produced which may result in damage or destruction to the antenna or its mount when operated under high wind conditions.

It is, therefore, a primary object of the present invention to provide an improved low cost, simplified polar mount having the lowest possible center of gravity, the highest possible rigidity, and minimization of moment arms for the members forming the same to effectively resist deflections by wind created forces acting on the dish antenna and the polar mount and to orient the structural components of the polar mount on edge, parallel to the forces exerted on those members.

SUMMARY OF THE INVENTION

The present invention is directed to a polar mount for aligning a microwave directional antenna axis with a given satellite of a series of satellites within the satellite zone of the earth's equatorial geosynchronous orbit track, which polar mount is fitted to a vertically upright post. The polar mount comprises a post assembly mounted to the upper end of the post for rotating about the post vertical axis and includes means for fixing the post assembly at an angularly adjusted azimuth position. A rocker assembly comprising a rocker bar is pivotably mounted to the pipe assembly at the upper end of the post. It may include a pin passing through the rocker bar and defining an elevation pivot axis perpendicular to the aziumth axis and intersecting the same. An interface assembly comprising an open frame fixed to the dish antenna at its center further comprises paired frame tangs projecting outwardly from the open frame at diametrically opposed sides thereof. Means are provided for pivotably mounting the frame tangs, respectively, to opposite ends of the rocker bar to define an hour angle pivot axis for allowing the antenna to sweep the satellite zone of the geosynchronous orbit. Further, the hour angle pivot axis also intersects the azimuth and elevation axes of the polar mount to provide the lowest possible center of gravity for the polar mount. This produces a highly rigid polar mount to resist deflection by the wind and other forces and minimizes the moment arms acting on the members of the polar mount. The members are also oriented structurally on edge parallel to the forces being exerted on those members.

The post assembly may comprise a cylindrical tube of an internal diameter in excess of the outside diameter of the post and being rotatably, concentrically mounted thereon, and wherein the pin defining the elevation pivot axis passes completely through the tube and abutts the upper end of the post to fix the vertical height of the post assembly, the rocker assembly, and antenna mounted thereby. The rocker assembly may comprise an open box formed by laterally spaced back to back channel bars with end plates fixedly joining the opposite ends of the channel bars. Quadrant plates integral with the channel bars extend downwardly on respective sides of the post assembly. The quadrant plates each include an arcuate sector edge and at least one locking screw is threaded to the post assembly on each side and bears on the quardant plate along the sector edge to lock the rocker assembly in predetermined angular position about the elevation pivot axis to permit proper tracking of the satellite within the satellite zone of the geosynchronous orbit.

The upper of the two frame tangs includes an elongated slot parallel to its longitudinal axis to permit the interface assembly to be shifted in the plane of the upper frame tang through nine degrees to adjust the antenna to the declination angle required by the physical position of the antenna and polar mount on the earth's surface relative to the plane of the geosynchronous orbit, i.e. north or sourth of the equator. The quadrant plates may include arcuate shaped slots remote from the channel bars to form the arcuate sector edge. Alternatively, the ends of the quadrant plates remote from the channel bars may terminate in an arcuate edge whose radius corresponds to the elevation axis pin mounting the rocker assembly to the post assembly. A pair of ball joints fixed respectively to the centers of the end plates joining the channel bars include bolts projecting outwardly from the ball elements of the joints, which bolts are received within holes within the frame tangs remote from the open frame mounting the antenna to define the hour angle pivot axis for the polar mount. The hole within the upper frame tang is in the form of an elongated slot to permit a nine degree shifting of the hour angle pivot axis at that end to provide a declination adjustment to the antenna mounted thereby. A jack plate may be welded across the ends of the rocker quadrant plates at right angles to the channel bars of the rocker assembly, and a linear motor may be connected between the jack plate and the interface frame assembly to cause the antenna to sweep the satellite zone of the geosynchronous orbit through the hour angle pivot axis. Set bolts coupled to the post assembly lock the post assembly at a predetermined azimuth position to the upstanding vertical post. The post assembly may comprise a cylindrical tube concentric about the post and through the upper end of which is mounted the elevation axis pin. Alternatively, facing channel bars may be welded to the tube for rigidity. As a further alternative, facing channel bars abut the periphery of the post and are flange connected by bolt and nut means to effect a relatively strong rigid post assembly, in place of the tube. The post assembly may comprise formed arcuate plates having flanges along the sides thereof for bolt and nut connection, and wherein the edges of the arcuate plates are serrated so as to engage the periphery of the post under high friction to rigidly secure the post assembly to the post at an azimuth adjusted position.

BRIEF DESCRIPTION OF THE DRAWINGS

FIG. 3 is a side elevational view of a polar mount similar to that shown in FIG. 1, constituting a second embodiment of the present invention.

FIG. 4 is a vertical sectional view of the pipe assembly and post of FIG. 3, taken about line 4—4.

FIG. 5 is a transverse sectional plan view of a portion of the polar mount of FIG. 3, taken about line 5—5.

FIG. 6 is a transverse sectional view of a portion of the polar mount of FIG. 3, taken about line 6—6.

FIG. 7 is a vertical elevation of a pipe assembly and post forming a further embodiment of the invention.

FIG. 8 is a top plan view of the pipe assembly of FIG. 7.

FIG. 9 is an exploded, perspective view of a pair of elements forming a post assembly constituting yet another embodiment of the present invention.

FIG. 10 is a top plan view of the pipe assembly of FIG. 9 mounted to a vertical post.

In the various embodiments of the invention, like numerals are employed to designate like elements.

DESCRIPTION OF THE PREFERRED EMBODIMENTS

Figure 1:
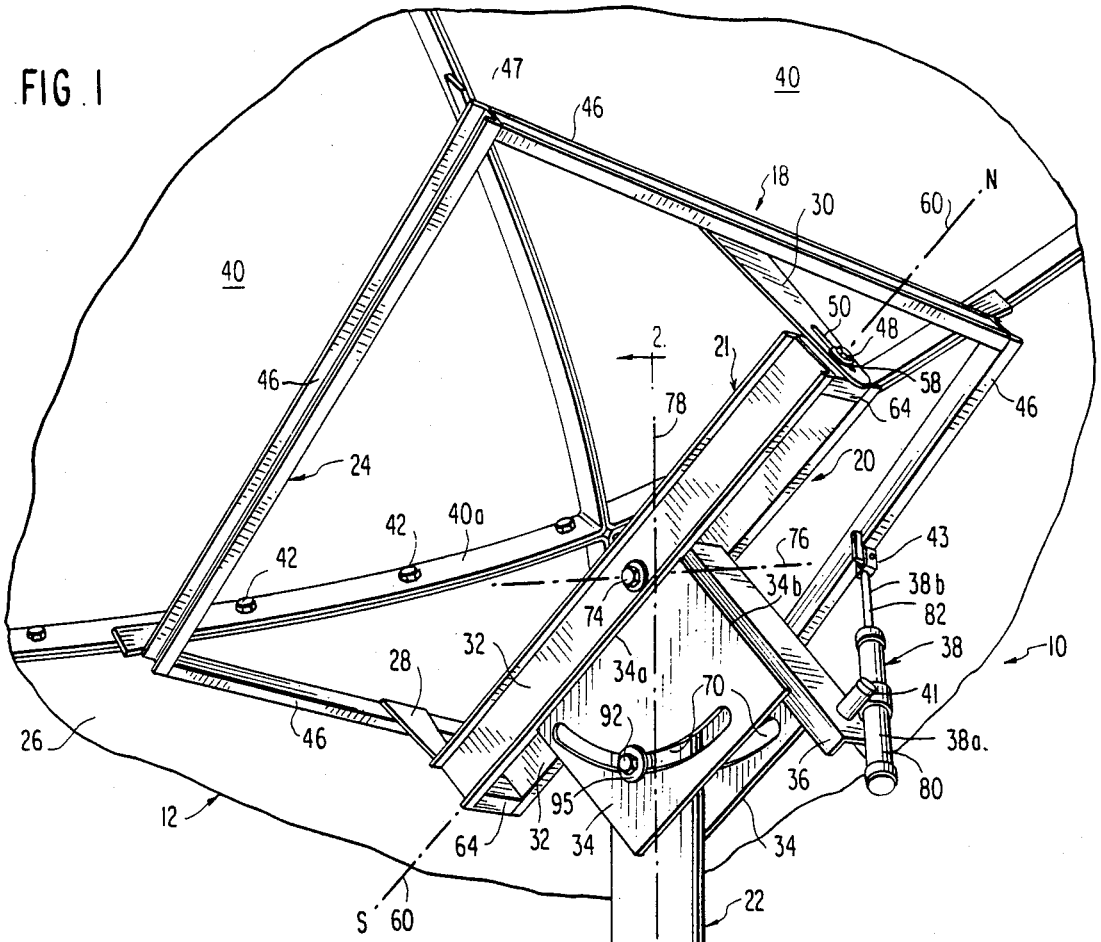
FIG. 1 is a perspective view of the microwave polar antenna mount forming a first embodiment of the present invention and a portion of the antenna mounted thereby.
Figure 2:
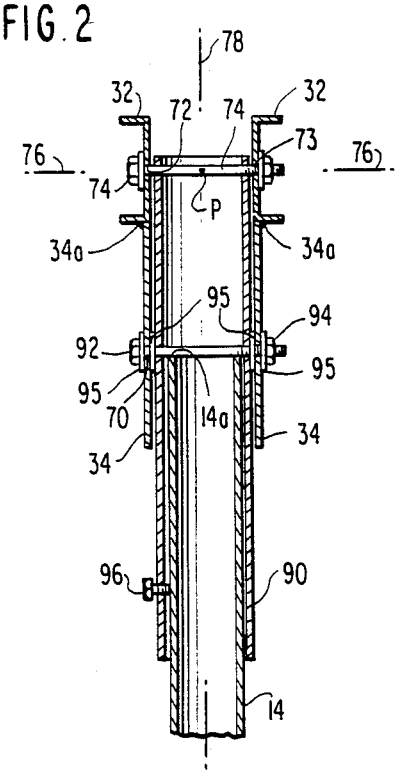
FIG. 2 is a vertical sectional view of the antenna mount of FIG. 1 taken about line 2—2 thereof.

Referring to FIGS. 1 and 2, there is illustrated an improved low cost, compact microwave antenna polar mount indicated generally at 10 which forms a first embodiment of the present invention. The polar mount 10 functions to support a dish-type microwave antenna, indicated generally at 12, and the polar mount is fixedly mounted to the upper end of a vertical upstanding post 14 which may be solid or may constitute a hollow cylindrical pipe, and which is preferably mounted within ground G by being embedded in a poured concrete base or support 16.

The polar mount consists of three major subassemblies, which are: an interface assembly, indicated generally at 18; a rocker assembly, indicated generally at 20; and a post or pipe assembly, indicated generally at 22.

The interface assembly 18, which consists principally of an open interface frame 24, may or may not be considered part of the mount 10, depending upon the design of dish 26 consituting the principal component of the dish antenna 12. Assembly 18 further includes a lower frame tang 28 and upper frame tang 30 functioning to attach the open frame 24 to the rocker assembly 20.

The rocker assembly 20 comprises back-to-back, laterally spaced rocker bars or channel bars 32. Rocker quadrant plates 34 are attached to the channel bars 32 by being welded thereto or integrally formed therewith and which are also physically joined at one end by a jack plate 36 which extends at right angles to the channel bars 32 and which is physically welded or otherwise joined to parallel ends of the rocker quadrant plates 34. Jack plate 36 functions to mount a linear motor indicated generally at 38, at one end, by pivot mount 41. The opposite end is coupled to the interface open frame 24 by coupling 43 to facilitate sweeping of the satellite zone of the geosynchronous orbit to lock the antenna onto a given one of the satellites therein.

The function of the third major assembly, pipe or post assembly 22, is to support all of the above on the vertical upstanding post 14 which is usually a schedule 40 pipe projecting upwardly from the block of cement 16, in ground G.

The dish antenna 12 may comprise a plurality of sector-shaped segments as at 40 whose edges are flanged as at 40a and which edges may be bolted together at various locations via nut and bolt assemblies 42. The open frame 24 is illustrated as being of rectangular configuration comprising four end-to-end connected beams such as channel bars 46, whose ends are welded together as at 47 to form the open frame 24. The upper and lower frame tangs 30, 28 are formed of flat pieces of steel or aluminum and are normally somewhat triangular in plan configuration. Their purpose is twofold: to attach the interface frame 24 which holds the dish 26 to the rest of the mount 10 and to provide for a declination adjustment of between 0 and 9 degrees for the specific antenna latitude location. If the interface frame is formed of steel, the upper and lower frame tangs may be welded directly to the interface frame 24. If the interface frame 24 is of other material such as a softer metal as aluminum, the frame tangs may be bolted to the interface frame at opposite ends of the same. The lower frame tang 28 (a southern tang in the northern hemisphere or the northern tang in the southern hemisphere) has a single circuilar hole (not shown) at its end remote from the interface frame 24 to accept a bolt, similar to that at 48 for tang 30, which connects it to the rocker assembly 20. The upper frame tang 30 is longer than the lower frame tang 28, and instead of having a circular hole, it is provided with an elongated slot 50 extending along its longitudinal axis, so that the entire interface frame assembly 18 may be adjusted relative to the rocker assembly (which is aligned with the polar axis) to vary the angle of declination between 0 and 9 degrees, depending upon the earth's lattitude at the location of the antenna 12 and its mount 10. It locks the declination angle of the antenna (antenna axis). This is accomplished by placement of washers 58 on either side of the upper frame tang slot 50 so that when the bolt and washer combination is tightened, the upper frame tang 30 is locked in place relative to the hour angle pivot axis, indicated generally at 60, defined by the lower bolt and upper bolt 48.

As mentioned previously, the linear motor 38 is physically connected at one end **38*a* to the jack plate 36, remote from channel bars 32, while its opposite end constituted by an extensible and retractable rod 38*b* is fixed by a suitable coupling as at 43 to the interface frame 24. By expanding or retracting the linear motor 38**, the antenna axis sweeps across the satellite zone of the geosynchronous orbit seeking out the satellite so selected.

Turning to the rocker assembly 20, the rocker assembly 20 forms the heart of the polar mount and constitutes its major element. The rocker assembly 20 constitutes a box-shaped rocker bar 21 defined by the opposite, back-to-back, outwardly facing, laterally spaced channel bars 32 which are physically joined together, by welding end caps or end plates 64 between the channel bars, at their ends. Each of the rocker end caps or end plates 64 are provided with a ball joint 66, formed of ball and socket members with the socket welded or bolted thereto in the center thereof. Bolts 48 project axially outwardly from the ball members of the joints 66, and pass, respectively, through the circular hole within the lower frame tang 28 and slot 50 of the upper frame tang 30. Nuts 68 threaded to the ends of the bolts function to locate the upper and lower frame tangs on the bolts 48, fixing the tangs to the ends of the rocker assembly 20 while allowing rotation of the rocker assembly about the hour angle pivot axis 60 defined thereby through operation of the linear motor 38. The rocker quadrant plates 34 are welded along edges **34*a* to each channel bar 32 such that the radius formed by quadrants slots 70 (or their equivalent) is centered on a hole 72, FIG. 2, in each of the channel bars 32 of the rocker assembly 20. Upper main rocker bolt 74, which extends through the holes 72 of channel bars 32 and holes 73 of tube 90, serves as the main axle about which rocker assembly 20 and the interface frame assembly 18 rotate together and defines elevation axis 76 for the antenna 12**. This provides the elevation adjustment for the polar mount required to achieve proper tracking of the satellites within the Clarke orbit.

The box-type rocker assembly 20 also defines the hour angle axis 60 which is at right angles to the elevation axis 76 and which, in turn, is at right angles to the azimuth axis 78, all intersecting at a single point to concentrate the forces acting on the polar mount. The hour angle axis 60 points geographically north once the mount is properly oriented, and that axis 60 is defined by the two ball joints 66, one in each end of the rocker assembly and specifically within the end plates 64. Axis 60 is provided with south and north designations at left and right ends, respectively, FIG. 1.

Jack plate 36, which is welded to each of the quadrant plates 34 along the north ends or edges **34*b* of the quadrant plates 34, functions to support the linear motor 38 which may comprise a hydraulic jack or pneumatic jack. The jack plate 36 thus serves as a foundation for a pivot mount 41 for the barrel or non-movable portion 80 of the linear motor or hydraulic jack 38. The extendable and retractable rod 82 forming the other end 38*b* and the movable component of the positioning jack 38, is pivotably mounted by a suitable coupling 43 to the interface frame 24. The jack plate 36 may constitute a flat steel or other sheet metal plate spanning across the north ends of the rocker quadrant plates 34** or, if necessary, it may be of channel shape for stiffness.

The ball joints 66 in each of the rocker end caps 64 serve to accommodate the rotation of the interface frame assembly 18 which is usually at an angle to the rocker assembly except at the equator about the polar axis. The ball joints and their connections to tangs 28, 30, in this embodiment are identical to that of FIG. 3, which is an alternate embodiment of the invention. The bolts 48 which go through the hole 49 and the slot 50 of the lower frame tang 28 and upper frame tang 30, respectively, serve as the main axles about which the rocker assembly 20 and the interface frame 24 rotate. The ball joints 66 allow the interface frame 24 to rotate about the polar axis 60 without binding.

Turning to the third major subassembly, post or pipe assembly 22, in the illustrated embodiment of FIGS. 1 and 2, this constitutes a hollow cylindrical tube 90 having an internal diameter which is in excess of the external diameter of post 14 so that it can rotate about the post and thus about azimuth axis 78. Tube 90 may constitute a round section of pipe sized to slip over the smaller schedule 40 pipe 14. Rocker bar assembly 20 is formed such that the outwardly facing channel bars 32 are spaced apart at some distance, slightly greater than the diameter of tube 90. Further, the elevation axis pin 74 goes through tube 90 adjacent the upper open end of tube 90 via holes 73. Further, a second through bolt 92 projects through arcuate slots 70 within the rocker quadrant plates 34, and the through bolt 92 is provided with a nut 94 with suitable washers 95 adjacent the head of bolt 92 and between a rocker quadrant plate 34 and nut 94, such that by tightening down on the nut 94, the rocker quadrant plates 34 are physically locked to tube 90 with the antenna 12 at the proper elevation angle. Bolt 92 rests on the top **14*a* of post 14 to vertically locate post assembly 22, rocker bar assembly 20 and interface frame assembly 18. This, of course, does not prevent the linear motor 38 from rotating the antenna 12 through interface frame 24, about the sweep or hour angle pivot axis 60. Additionally, set screws as at 96 are threaded to the exterior of tube 90 and engage post 14 to frictionally lock the tube 90 and prevent its rotation about post 14, once the antenna is set at the proper azimuth angle. Alternatively, the post assembly 22 may be drilled at several locations and nuts may be welded on the interior of tube 90 to accommodate set bolts which prevent the entire mount from turning on the pipe or post 14 set in the ground G. Note that the azimuth axis 78 formed by this assembly 22 intersects the elevation axis 76 and the hour angle axis 60 at a point P, FIG. 2, and this point is close to the top of the post. In the embodiment of FIG. 1, this point of intersection is above the upper end or top 14*a* of post 14, upon which the assembly rests, through bolt 92. In the other embodiments, the bolt or pin defining the elevation axis and rotatably mounting the rocker assembly 20 to post assembly 22, literally rests on the top of the post 14 to bring the center of gravity to its lowest possible point for the polar mount 10**.

As may be appreciated, the key to the effectiveness of the simplified polar mount in its various forms is that all three axes of motion intersect in a point which is at or very close to the top of the post which holds the mount. The purpose of any polar mount is to hold the dish as rigid as possible for as a reasonable a price as possible. Because the cost of the mount may be proportional to its weight, stiffness to weight ratio, as in the instant invention, is maximized. The overall stiffness of any mount is the sum of all play or lack of play in every element or component of the mount including structural members, joints, the actuator and the attachment of the mount to the ground or building. In a polar mount, the forces that act on the antenna dish are transmitted along paths which are either parallel or perpendicular to each of the motions of travel in the mount. These motions are azimuth (rotation about the post 14), elevation (rotation about the main rocker bolt 74), and hour angle (rotation about the polar axis 60). The present invention resists motion in these directions by reason of several design details.

First, to resist motion about the hour angle or polar axis 60, the sheet material forming the frame tangs and the jack plate is positioned so that the sheet material surfaces are perpendicular to that axis. This is analogous to the fact that the stiffness of a piece of cardboard or any flat material on its edge is significantly higher than the stiffness along its major flat surface. The present invention employs back-to-back or facing channel bars and to form a rocker bar assembly structure analogous to an I-beam. It is the web which gives the channel bars their strength. The channel bars 32 serve only to hold the web parallel to the forces applied to it. The frame tangs 28, 30 and jack plate 36 form the two major elements connected by the jack 38 to resist motion about the polar axis which is very important in maintaining alignment with the given satellite thousands of miles therefrom.

To resist motion about the elevation axis 76, large surface areas perpendicular to the axis 76 and therefore parallel to the forces applied are brought together to form a frictional joint. This is the function of the rocker quadrant/post channel joint described previously. Through bolt 92, when tightened, holds the quadrant plates 34 firmly towards and about the periphery of tube 90 of pipe or post assembly 22, preventing rotation of the rocker assembly 20 about the elevation axis 76. The friction of any washers under the head of the through bolt and in contact with the nut on the opposite side also assist this function, as does the upper main rocker bolt 74. Once the rocker assembly 20 is bolted to the post assembly 22, there is also an element of torsional resistance to motion about the polar axis 60 by reasons of the large surface areas in contact with each other between the post assembly 22 and the rocker assembly 20. Two large surfaces in contact with each other form a more stable interface than two relatively small surfaces in contact with each other.

The third motion to be resisted is that about the azimuth axis 78, i. e. the vertical axis of post 14. This is accomplished by means of set screws 96 (or equivalent set bolts) and, as will be seen later, by the addition of serrations along edges of flanges of a cast or otherwise formed multi-segment post assembly 22. Further, these serrated edges may be case hardened to assure that the channel members formed thereby will dig into the periphery of post 14 to which they are mounted in like manner to the embodiment of FIG. 1.

Referring next to FIG. 3, a modified embodiment of the invention is illustrated as functioning to support a dish-type antenna and like members bear like numerals. Again, the principal components of the polar mount constitute an interface frame assembly indicated generally at 18', a rocker assembly indicated generally at 20' and a pipe or post assembly indicated generally at 22'.

The interface frame assembly 18' differs in that, instead of a rectangular interface frame, there is provided a tubular metal or rolled ring interface frame 100 having mounted thereto at circumferentially spaced positions a number of U-bolts 102 which function to mount upstanding L-shaped tabs 104 bearing holes at 106 for bolting, onto the interface frame 100, the sections of the dish antenna at their flanges (not shown) by way of nuts and bolts or similar connectors. Lower frame tang 28 and upper frame tang 30, which may be identical to that of the prior embodiment are fixedly mounted, at one end, to the bottom of the interface frame 100 by way of angle bars as at 108, which angle bars 108 are parallel to each other and welded at their ends to the periphery of the rolled ring interface frame 100.

The rocker assembly 20' is similar to the rocker assembly 20 of the first embodiment. However, the rocker quadrant plates 34' do not include arcuate slots but instead an arcuate edge **34*c* constitutes the sector edge of each rocker quadrant plate 34'. Plates 34' are physically clamped to pipe channels 114 by means of diametrically opposed set screws 112 which are threaded to nuts 110 within pipe or post assembly 22' as best seen in FIG. 6. Jack plate 36 is welded to the north ends of the locker quadrant plates 34' along both its edges in the manner of the prior embodiment. Further, the rocker assembly 20' comprises a rocker bar 21 consisting of outwardly directed, back-to-back, laterally opposed channel bars 32 with end plates 64 welded to its ends in the manner of the prior embodiment. Ball joints 66 are provided at both ends, and the projecting bolts 48 from the ball joints 66 pass through hole 49 within the lower tang frame 28 and an elongated slot 50 within the upper frame tang 30, identical to the prior embodiment, FIG. 1. Unlike FIG. 1, a pair of elevation axes defining screws 75 project through holes 77 within the laterally opposed channel bars 32 and terminate short of tube 90**.

Also, unlike the first embodiment, the pipe or post assembly 22' is not only composed of an outer tube 90 which slides on post 14, but additionally, as best seen in FIG. 3, a pair of facing channel bars or pipe channels 114 are welded at their edges **114*a* to the outer periphery of the outer tube 90. These channel bars 114 function to stiffen the pipe or post assembly 22'. This permits nuts as at 79 to be welded to the inside of web portions 114*b* of the channel bars or pipe channels 114 in line with holes 81 through which the threaded ends of screws 75 pass. The screws bear washers as at 83, and the screws 75 are loosened to permit the rocker assembly 20 to be rotated about elevation axis 76, FIG. 5, in the manner of the prior embodiment to place the antenna via mount 10 at proper elevation. Further, other nuts as at 110 are welded on the inside of the web portion 114*b* of the channel bars 114. Further, a hole 118 is provided within each of the channel bars 114 opening to the threaded nuts 110 which receive short length screws 112. A washer or washers 120 engage the arcuate edge 34'c of the rocker quadrant plate 34' on each side, while the washer 120 further engages a thrust pad 122 which is welded to the outer surface of web portion 114b of the channel bars below the hole 118 through which passes the screw 112. Thus, the screws 112 lock the rocker quadrant plates along edges 34'c remote from their welded connection to channel bars 32 of the rocker assembly to the pipe or post assembly 22', to fix the antenna at the proper elevation angle, i. e. about elevation axis 76' defined by screws 75** in this embodiment.

In order to prevent the pipe or post assembly 22' from falling down the post 14, a pair of stops or blocks 115 are welded to the interior of tube 90 at its upper edge which rest on the top 14a of post 14. Further, tube 90 is provided with laterally opposed holes 124, nuts 126 are welded to the exterior of the same, and set bolts or set screws 128 are threadably received by the nuts 126 with their ends projecting through holes 124 and frictionally engage the periphery of post 14. Thus, the post assembly 22' is drilled at several locations and nuts 126 welded thereon to accommodate the set bolts 128.

The pipe or post assembly 22' of FIG. 3 may be additionally simplified by; doing away with the exterior tube or pipe 90 between the post 14 and the pipe channel members 114, moving the set bolts 128 to the pipe channel members 114 themselves and fitting flanges with holes within them to the sides of the pipe assembly channel bars 114 so the flanges straddle the post and bolting the channel bars directly to the post. Further, an upper main rocker bolt 74 may then pass clear across the top of post 14. Thus, bolt 74 would prevent the entire unit from falling down to the ground about the post 14. Considerable weight is saved in making this change, and an important additional feature is created. By using common pipe sizes for the initial embodiment and, in fact, the embodiment shown in FIGS. 2 and 3, there is always some slop between the post 14 and the pipe or post assembly 22'. By bolting facing channel bars as at 114 directly to the post, they self center and align themselves tightly to the post 14.

As may be appreciated, certain changes may be made in the structure of the high rigidity, low center of gravity polar mount. Certain of those changes are evident from the description of the various embodiments. Additionally, since it is desirable to utilize the upper main rocker bolt 74 as the element to define or position the vertical height of the interface frame assembly, the rocker assembly and the post assembly by permitting that bolt to rest on the top of vertical post 14, it is preferred that any lower screws or bolts do not pass through the post assembly. This is true, particularly for the bolts which lock the rocker quadrant plates to the sides of the post after rotation of the rocker assembly to place the antenna axis at proper elevation. In that respect, the set screws as at 112 in the embodiment of FIG. 2 may be shifted to the left or right of outer tube 90 in that embodiment. Additionally, while a single set of screws 112 are provided in that embodiment, at the center line of the tube 90 on both sides of the tube, paired screws may be employed in side by side fashion bearing washers as at 120 and contacting the rocker quadrant plate 34 about arcuate sector edge 34c and thrust pad 122.

Reference to FIGS. 7 and 8 shows this variation in the production of the polar mount. In FIGS. 4 and 5, only the members making up the pipe or post assembly 22'' are shown with that assembly being mounted to the upper end of post 14. In FIGS. 7 and 8, a pair of channel members or channel bars 114' are employed having integral or separately formed flanges 130 as lateral extensions which may be welded at 114'a to the sides of the 114'c of the channel bars 114'. In this arrangement, opposed flanges 130 are provided with aligned holes as at 132 through which project pipe clamping bolts 134 bearing nuts 136 and washers 132 on their threaded ends. These pipe clamping bolts 134 function to clamp the channel bars directly to the exterior of post 14. Edges 114'd of the channel bars 114' may be serrated to bite or dig into the periphery of the pipe 14''. Additionally, as may be seen in FIGS. 7 and 8, holes are formed within the channel bars 114' at their upper ends remote from flanges 130 through which projects upper main rocker bolt 74 which spans across and abuts the upper edge 14a of the post 14, thereby locating the elevation pivot axis 76 as close as possible to the upper end of post 14 and which, of course, forms the point P at which all of the all three pivot axes intersect for the mount incorporating the elements of the other embodiments. The upper main rocker bolt 74 in passing clear across post 14 establishes the vertical height of the pipe or post assembly 22'' on the post 14.

In addition, set bolts 140 are threaded to the web portion 114'b of each of the channel bars 114', and engage the post 14 to frictionally lock the pipe or post assembly 22'' and prevent its rotation about the vertical azimuth axis 78'' once assembly 22' is rotated to proper azimuth position. A thrust pad 122 is welded at each side to the channel bar 114' between a hole 118 within that channel bar 114' and the set screw or set bolt 140 on that side, there being appropriate nuts 142 welded to the interior of channel bars 114' at web portion 114'b which receives the threaded end of screws identical to screws 112 of the embodiment of FIG. 3 to clamp down on the rocker quadrant plates.

Thus, the embodiment of the invention shown in FIGS. 7 and 8 involves the substitution of a pipe or post assembly 22'' for the pipe or post assembly 22' of the embodiment of FIGS. 3 to 6.

Referring next to FIGS. 9 and 10, there is illustrated the components forming yet another pipe or post assembly indicated generally at 22'''. In this case, paired castings or cast channel members 150 of iron or aluminum are provided which are identical and which include concave faces 152 facing each other whose radius of curvature R is smaller than the radius of curvature R' of the post 14 upon which they are mounted. Thus, R which is the radius of curvature of the facing surfaces 152 of the cast channel members 150 is smaller than the radius of curvature R' for the outside diameter of hollow post 14. The cast channel members 150 are of elongated bar form, including an upper edge 154, a lower edge 156, and side edges 158. The side edges at face 152 are serrated as at 160 so that the serrations will bite into the periphery of the post 14'''. Further, holes 162 are drilled at the top of the cast channel members 150, and paired holes are provided at 164, 166 near the bottom and between integral raised or projecting thrust pads 168. Also integrally formed, are laterally opposed flanges as at 170 through which project pipe clamping bolts 172 whose threaded ends bear washers 173 and nuts 174 to permit tightening down of the two cast iron or aluminum channel members 150 so that their serrated edges 160 bite into the periphery of post 114 to frictionally lock these members principally defining the pipe or post assembly 22''', FIG. 10.

As may be appreciated, the through holes 162 allow passage of one upper main rocker bolt 74 as in the prior embodiments. Further, as may be appreciated, a pair of pockets as at 176, 178 are provided within arcuate concave surface 152 of each of the cast channel members 150, within which are positioned nuts 180. The pockets 176, 178 may be of hexagonal shape to hold correspondingly shaped and sized nuts 180. As such, set bolts (not shown) pass through the lower holes 166 and are threaded to the lower of nuts 180 functioning to frictionally lock the channel members 150 to the post 14 at proper azimuth position. Additional bolts (not shown) pass through holes 164 and are received by other hex-shaped nuts 180 within recesses 176 to lock the quadrant plates in engagement with the pipe or post assembly channel bars 150, with the rocker assembly 20 at proper elevation.

While casting is employed rather than a fabricated steel or aluminum part by welding components together, each of the pipe or post assembly channel members 150 could be manufactured by a single stamping. In casting or stamping, the serrations may be readily formed into the same. If there is significant frictional holding by the serrations, the set bolts can be done away. If necessary, the serrated edges of the cast or stamped channel members 150 can be case hardened.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A polar mount for aligning the axis of a microwave directional dish antenna with a given satellite of a series of satellites within the satellite zone of the earth's equatorial geosynchronous orbit track, said polar mount being fixedly positionable on a vertically upright post, said mount comprising:

a post assembly mounted to the upper end of the post for rotation about the post vertical azimuth axis, said post assembly comprising a cylindrical tube having an inner diameter in excess of the outer diameter of the post and being concentrically rotatably mounted thereon, means for fixing the post assembly at an angularly adjusted azimuth position about said post vertical azimuth axis, a rocker assembly comprising a rocker bar, quadrant plates integral with said rocker bar and extending downwardly on respective sides of the cylindrical tube, in proximity to the upper end of said post, a pin means pivotably coupling said rocker bar to said post assembly and defining an elevation pivot axis perpendicular to the azimuth axis and intersecting the same, and means for functionally locking said quadrant plates to said cylindrical tube to fix said rocker bar in predetermined angular position about the elevation pivot axis to permit proper tracking of the satellite within said satellite zone of the geosynchronous orbit, an interface assembly, said interface assembly comprising an open frame for fixed attachment to the dish antenna, paired frame tangs projecting outwardly of said open frame at diametrically opposite sides thereof, means for pivotably mounting said frame tangs, respectively, to opposite ends of said rocker bar to define an hour angle axis for allowing the antenna to sweep the satellite zone of the geosynchronous orbit with said hour angle axis intersecting the aximuth axis and elevation axis of the polar mount to provide the lowest possible center of gravity for the polar mount, with said post assembly cylindrical tube, said rocker bar and said quadrant plates integral with the rocker bar and extending downwardly on respective sides of the cylindrical tube and being frictionally locked thereto forming an anti-torsion assembly to thereby create a highly rigid polar mount which resists deflection by wind.

2. The polar mount as claimed in claim 1, wherein said pin means defining the elevation pivot axis comprises a pin passing completely through said tube and abutting the upper end of the post to fix the vertical height of the post assembly, the rocker assembly and the antenna mounted thereby.

3. The polar mount as claimed in claim 1, wherein said rocker bar comprises an open box formed by laterally spaced back-to-back channel bars, end plates fixedly adjoining the opposite ends of the channel bars together, and wherein said quadrant plates are integral with said channel bars respectively, said quadrant plates including an arcuate sector edge remote from said channel bars, and wherein at least one locking screw on the post assembly, bearing on the quadrant plates along the sector edges thereof, frictionally locks the rocker assembly against said post assembly cylindrical tube in predetermined angular position about the elevation pivot axis.

4. The polar mount as claimed in claim 2, wherein said rocker bar comprises an open box formed by laterally spaced back-to-back channel bars, end plates fixedly adjoining the opposite ends of the channel bars together, quadrant plates integral with said channel bars and extending downwardly on respective sides of the post assembly, said quadrant plates including an arcuate sector edge remote from said channel bars, and at least one locking screw on the post assembly bearing on the quadrant plates along the sector edges thereof to frictionally lock the rocker assembly to said post assembly in predetermined angular position about the elevation pivot axis to permit proper tracking of the satellite within said satellite zone of the geosynchronous orbit.

5. The polar mount as claimed in claim 3 wherein said frame tangs comprise an upper frame tang having a longitudinal axis and a lower frame tang, said lower frame tang including a circular hole within the end remote from the open frame, the upper frame tang including an elongated slot extending along the upper frame tang longitudinal axis, and members projecting outwardly from said rocker assembly end plates at right angles thereto and being aligned with each other and passing through said circular hole and said elongated slot within said upper frame tang, and means for locking said projecting members within said upper frame tang elongated slot at a longitudinally adjusted position within said slot corresponding to the declination angle for said interface assembly required by the physical position of the antenna and the polar mount on the earth surface relative to the plane of the satellite geosynchronous orbit.

6. The polar mount as claimed in claim 3, wherein said quadrant plates each include arcuate shaped slots remote from said channel bars to form the arcuate sector edge.

7. The polar mount as claimed in claim 6, wherein the end of each said quadrant plates remote from said channel bar terminates in an arcuate edge whose radius corresponds to the elevation axis pin mounting the rocker assembly to the post assembly such that said at least one locking screw carried by the post assembly frictionally engage the quadrant plates at said arcuate edge to lock the rocker assembly and the antenna carried thereby at a predetermined elevation.

8. The polar mount as claimed in claim 5, wherein said members projecting from said end plates comprise a pair of ball joints rotatably mounted respectively, to the centers of the end plates joining the back-to-back channel bars and bolts projecting outwardly from said ball joints, said bolts being received respectively within the circular hole of the lower frame tang and the elongated slot within the upper frame tang to thereby define the hour angle pivot axis for the polar mount and nuts on said bolts fixedly locking said bolts to said upper and lower and lower frame tangs, respectively.

9. The polar mount as claimed in claim 8, further comprising a jack plate welded across corresponding ends of the rocker quadrant plates at right angles to the channel bars of the rocker assembly, and a linear motor pivotably connected at one end to the jack plate and at its other end to said interface frame assembly to effect, upon energization thereof, the sweep of the antenna through the satellite zone of the geosynchronous orbit and about the hour angle pivot axis.

10. The polar mount as claimed in claim 1, further comprising set bolts coupled to the post assembly and engaging the upstanding vertical post to lock the post assembly at a predetermined azimuth position.

11. The polar mount as claimed in claim 9, further comprising set bolts coupled to the post assembly and engaging the upstanding vertical post to lock the post assembly at a predetermined azimuth position.

12. The polar mount as claimed in claim 3, wherein said post assembly comprises a short length cylindrical tube concentrically positioned about the post, and wherein the elevation axis pin projects through the upper end of said cylindrical tube with opposite ends of said pin mounted to said back-to-back channel bars, respectively.

13. The polar mount as claimed in claim 5, wherein said post assembly comprises a short length cylindrical tube concentrically positioned about the post, and wherein the elevation pivot axis defining pin means projects through the upper end of said cylindrical tube and the ends of said pin means are mounted respectively to said back-to-back channel bars.

14. The polar mount as claimed in claim 11, further comprising facing channel bars welded to said cylindrical tube on the outside thereof to impart structural rigidity to the tube.

15. The polar mount as claimed in claim 1, wherein said post assembly comprises a pair of facing channel bars of a lateral width less than the diameter of said post, aligned, paired flanges projecting laterally outwardly of said channel bars on both sides thereof at one end thereof, said flanges extending beyond said post to each side thereof, and bolt and nut means joining said channel bars at said flanges and extending across both sides of said post to form a highly rigid post assembly.

16. The polar mount as claimed in claim 15, wherein the edges of said channel bars abutting the periphery of the post are serrated to effect high friction engagement between the channel bars and the periphery of the post by screwing down said bolt and nut means to frictionally secure the post assembly to the post at an azimuth adjusted position.

17. The polar mount as claimed in claim 13, wherein said interface frame comprises a tubular metal ring, mounting means carried by said tubular metal ring at circumferentially spaced positions for coupling said tubular metal ring to said antenna, and cross bars fixedly mounted to the tubular metal ring and spanning across said tubular metal ring from one peripheral point to the other and being parallel to each other, and wherein said upper and lower frame tangs are integral at one end to said cross bars and are coupled at their opposite end, to said rocker assembly.

* * * * *